US012351996B2

(12) United States Patent
Bedard et al.

(10) Patent No.: US 12,351,996 B2
(45) Date of Patent: Jul. 8, 2025

(54) ROAD TAPING MACHINE

(71) Applicant: Graco Minnesota Inc., Minneapolis, MN (US)

(72) Inventors: Roland M. Bedard, Lindstrom, MN (US); John M. Bryce, Andover, MN (US); Todd B. Hillukka, Clearwater, MN (US); Dennis Kemmetmueller, Rogers, MN (US); August F. Legatt, Maple Lake, MN (US); Joshua Roden, Dayton, MN (US); Daniel D. Rohling, Corcoran, MN (US); Anthony J. Shakal, Rogers, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 18/673,742

(22) Filed: May 24, 2024

(65) Prior Publication Data

US 2024/0309595 A1 Sep. 19, 2024

Related U.S. Application Data

(63) Continuation of application No. 17/441,624, filed as application No. PCT/US2020/023614 on Mar. 19, 2020, now Pat. No. 11,993,899.

(Continued)

(51) Int. Cl.
*E01C 23/18* (2006.01)

(52) U.S. Cl.
CPC ..... *E01C 23/185* (2013.01)

(58) Field of Classification Search
CPC ..... E01C 23/185; E01C 23/18; E01F 9/512; E01F 9/576; E01F 9/578
See application file for complete search history.

(56) References Cited

U.S. PATENT DOCUMENTS

| | | | |
|---|---|---|---|
| 4,030,958 | A | 6/1977 | Stenemann |
| 4,317,696 | A | 3/1982 | Hutchinson et al. |

(Continued)

FOREIGN PATENT DOCUMENTS

| | | | |
|---|---|---|---|
| CA | 2320861 | A1 | 8/1999 |
| CN | 1943026 | A | 4/2007 |
| CN | 101094958 | A | 12/2007 |

OTHER PUBLICATIONS

First Office Action from Chinese Application No. 2020800296663, dated Jul. 11, 2022, 11 pages.

(Continued)

*Primary Examiner* — Abigail A Risic
(74) *Attorney, Agent, or Firm* — Kinney & Lange, P.A.

(57) ABSTRACT

A road taping machine is configured to unspool road marking tape from a spool and tamp that tape onto pavement via a tamping roller. Tape is cut using a blade assembly, and aligned with several alignment rollers. A pivot arm permits a subset of the alignment rollers to displace, allowing slack in the tape to be taken in during cutting such that taping can occur continuously, despite cuts. The spool is housed on an axle anchored to a support arm that can be actuated between an elevated position for loading, and a depressed position for taping. A taping section of the machine is laterally displaceable relative to a drive section via a displacement plate, to permit taping of laterally remote locations. The machine can support multiple spools, including spools with tape paths that bypass the blade assembly.

19 Claims, 9 Drawing Sheets

Related U.S. Application Data

(60) Provisional application No. 62/822,176, filed on Mar. 22, 2019.

(56) References Cited

U.S. PATENT DOCUMENTS

| | | | | |
|---|---|---|---|---|
| 4,824,516 | A | 4/1989 | Ishihara et al. | |
| 5,059,061 | A * | 10/1991 | Stenemann | E01C 23/185 404/94 |
| 6,413,013 | B1 | 7/2002 | Requena | |
| 9,284,699 | B1 | 3/2016 | Arnold | |
| 11,220,795 | B1 | 1/2022 | Shea et al. | |
| 2011/0229265 | A1 | 9/2011 | Schottka | |
| 2014/0064849 | A1 | 3/2014 | Arnold | |
| 2018/0274185 | A1 | 9/2018 | Rutherford | |
| 2019/0055702 | A1 | 2/2019 | Wilkens et al. | |
| 2020/0157750 | A1 | 5/2020 | Wilkens et al. | |

OTHER PUBLICATIONS

International Preliminary Report on Patentability for PCT Application Serial No. PCT/US2020/023614, dated Oct. 7, 2021, 18 pages.
International Search Report and Written Opinion from PCT Application Serial No. PCT/US2020/023614, dated Aug. 24, 2020, 24 pages.
Second Office Action from Chinese Application No. 2020800296663, dated Dec. 26, 2022, 18 pages.

* cited by examiner

ROAD TAPING MACHINE

CROSS-REFERENCE TO RELATED APPLICATION(S)

This application is a continuation of U.S. Utility patent application Ser. No. 17/441,624, which is a 371 of International Application No. PCT/US2020/023614 filed on Mar. 19, 2020, which depends from U.S. Provisional Patent Application No. 62/822,176, which are incorporated by reference in their entirety.

BACKGROUND

The present invention relates generally to road striping systems, and more particularly to improvements to a road taping machine designed to dispense, cut, and apply road marking tape to pavement.

Road marking tape is heavy duty, durable tape commonly used to delineate lanes or traffic requirements on roads. Road marking tape can include highly reflective layers or embedded reflective material, and is often used to replace or supplement painted road striping for improved visibility of traffic lines. During road construction, resurfacing, or repair, road marking tape is adhered on road surfaces, sometimes within grooves. Tape is typically obtained in the form of large spools, from which appropriate sections of tape must be unspooled, cut, and adhered to the road surface. Road marking tape is generally applied in straight lines or very gradual curves, but can be applied in short sections (e.g. for dashed road lines) or longer continuous sections. Short sections necessitate frequently cutting unspooling tape, and metering the application of tape sections to the road. Longer sections allow tape to be unspooled and applied generally continuously, but may necessitate splicing together tape sections when one spool is exhausted and must be replaced with another. Some applications may require the deposition of multiple parallel lines of tape.

Tape spools come in a variety of dimensions, including spools with narrower or wider inner and/or outer diameters, spools with thicker or thinner tape, and spools of different widths. Variations along any of these dimensions can limit the tools that can be used for road marking tape application. Thicker tape, for example, can be more resilient, and consequently require greater force to cut. Additionally, road taping jobs can require great lengths of tape, necessitating that tape spools be replaced several times of the course of a job.

SUMMARY

In one aspect, the present disclosure is directed toward a road taping machine configured to carry and apply road marking tape to pavement. The road taping machine includes a spool mount, a tamping roller, a blade assembly, a plurality of positioning rollers, and a pivot arm. The spool mount is disposed to rotatably receive a spool of the road marking tape. The tamping roller is configured to receive the road marking tape from the spool, and to force the road marking tape into the pavement via the weight of the road taping machine. The blade assembly is disposed between the spool mount and the tamping roller, the blade assembly configured to cut the road marking tape. The positioning rollers are disposed between the blade assembly and the tamping roller, and to retain one side of the road marking tape between the blade assembly and the tamping roller. The pivot arm supports a subset of the positioning rollers, thereby permitting at least one of the plurality of positioning rollers to deflect towards the tamping roller while the blade assembly cuts the road marking tape, such that the tamping roller continues to receive the road marking tape while the blade assembly cuts the road marking tape.

In another aspect, the present disclosure is directed toward a method of dispensing sections of road marking tape to pavement via a road taping machine. The road marking tape is unspooled from a spool, through a blade assembly, to a tamping roller that forces the road marking tape into the pavement via the weight of the road taping machine. The road marking tape is then cut using the blade assembly, and retained in engagement with a plurality of positioning rollers in positions along a path between the blade assembly and the tamping roller. The positioning rollers are displaced towards a different position closer to the tamping roller while cutting the road marking tape, thus shortening the path. The positioning rollers are then displaced back into the original position once the road marking tape has been cut.

In still another aspect, the present disclosure is directed toward a road taping machine configured to apply road marking tape from a spool into pavement via a tamping roller. The road taping machine includes a blade assembly disposed between the spool and the tamping roller to cut the road marking tape, and a tape alignment roller situated between the blade assembly and the tamping roller to retain the road marking tape therebetween. The tape alignment roller is movable to shorten a tape path between the blade assembly and the tamping roller.

In still another aspect, the present disclosure is directed toward a road taping machine including a rigid frame, a tape spool axle, and a spool loading assembly. The rigid frame is supported at a bottom side by a plurality of wheels. The tape spool axle is carried on the rigid frame, and is configured to receive and rotatably support a replaceable spool of road marking tape. The spool loading assembly is anchored to the rigid frame and the tape spool axle, and is adjustable between a taping position and a loading position. In the taping position, the tape spool is not removable from the tape spool axle. In the loading position, the tape spool is elevated further from the wheels than in the taping position, and is removable from the tape spool axle.

In still another aspect, the present disclosure is directed toward a method of operating a road taping machine with a rigid frame, a tape spool axle, a tape intake, and a pivot arm. The tape spool axle carries a replaceable spool, and pivot arm supports the tape spool axle. The pivot arm is rotated into a loading position wherein the tape spool axle is elevated and distanced from the tape intake. The replaceable spool is then inserted on the tape spool axle while the pivot arm is in the loading position. The pivot arm is next rotated into a taping position wherein the spool tape spool axle is depressed and brought closer to the tape intake, and road marking tape is fed from the replaceable spool into the tape intake.

In still another aspect, the present disclosure is directed toward a road taping machine with a drive section, a taping section, and a displacement mechanism. The drive section includes a rear wheel axle with wheels aligned parallel to a drive axis, and a drive mechanism configured to drive the road taping machine. The taping section is located adjacent the drive section along the drive axis, and includes a taping frame and a tamping roller. The taping frame is configured to support a tape spool, and the tamping roller is mounted on the taping frame and configured to tamp road marking tape from the tape spool into pavement beneath the road taping machine. The displacement mechanism includes an offset plate fixedly anchored to the drive or taping section, and the offset plate includes a first lateral groove. The displacement mechanism also includes a fastener translatably secured through the groove, such that the fastener can be tightened to the offset plate to lock the taping section in place relative to the drive section, and loosened from the offset plate to permit the taping section to be translated laterally relative to the drive section.

In still another aspect, the present disclosure is directed toward a method of operating a road taping machine. The road taping machine has a drive section and a taping section connected by a displacement mechanism. The drive section includes wheels, and the taping section includes a hose spool mount and a tamping roller that tamps road marking tape from the hose spool mount into pavement. First, a tape striping target location is ascertained relative to a width of the drive section. A fastener of the displacement mechanism is then unbound to permit translation of the taping section relative to the drive section. This permits the taping section to be translated relative to the drive section along a plane normal to a drive axis of the road taping machine, until the displacement of the taping section permits taping at the tape striping target location. The fastener is then rebound, locking the taping section relative to the drive section. The road taping machine can then be driven, applying road marking tape in the target location.

In still another aspect, the present disclosure is directed toward a road taping machine including a wheeled frame, a spool axis, a tamping roller, first and second set of alignment rollers, and a cutting assembly. The spool axis is rotatably mounted on the wheeled frame and configured to receive and rotatably support first and second spools of road marking tape. The tamping collar is disposed to tamp tape from both spools into a surface beneath the wheeled frame. The first and second sets of alignment rollers define a first and second tape paths from the first and second spools, respectively, to the tamping roller. The cutting assembly is disposed along the only the first tape path.

In still another aspect, the present disclosure is directed toward a method of operating a road taping machine having a spool axis, a tamping roller, and a cutting assembly disposed between the tamping roller and the spool axis. First and second tape spools are mounted on the spool axis, axially adjacent each other. Tape is then routed from the first tape spool along a first tape path, and from the second tape spool along a second tape path. The first tape path is at least partially defined by a plurality of alignment rollers, and extends through the cutting assembly to the tamping roller. The second tape path bypasses the cutting assembly. The road taping machine is then driven along a taping path so as to simultaneously apply tape from the first and second spools, in parallel.

In still another aspect, the present disclosure is directed toward a road taping machine having a wheeled frame, a spool axle, a tamping roller, a plurality of alignment rollers, and a splicing platform. The spool axle is supported on the wheeled frame and disposed to receive a spool of road marking tape. The tamping roller is rotatably mounted on the wheeled frame, in line with wheels of the wheeled frame. The alignment rollers define a tape path from the spool to the tamping roller. The splicing platform is disposed adjacent to and along the tape path.

The present summary is provided only by way of example, and not limitation. Other aspects of the present disclosure will be appreciated in view of the entirety of the present disclosure, including the entire text, claims, and accompanying figures The present summary is provided only by way of example, and not limitation. Other aspects of the present disclosure will be appreciated in view of the entirety of the present disclosure, including the entire text, claims, and accompanying figures.

Figure 1:
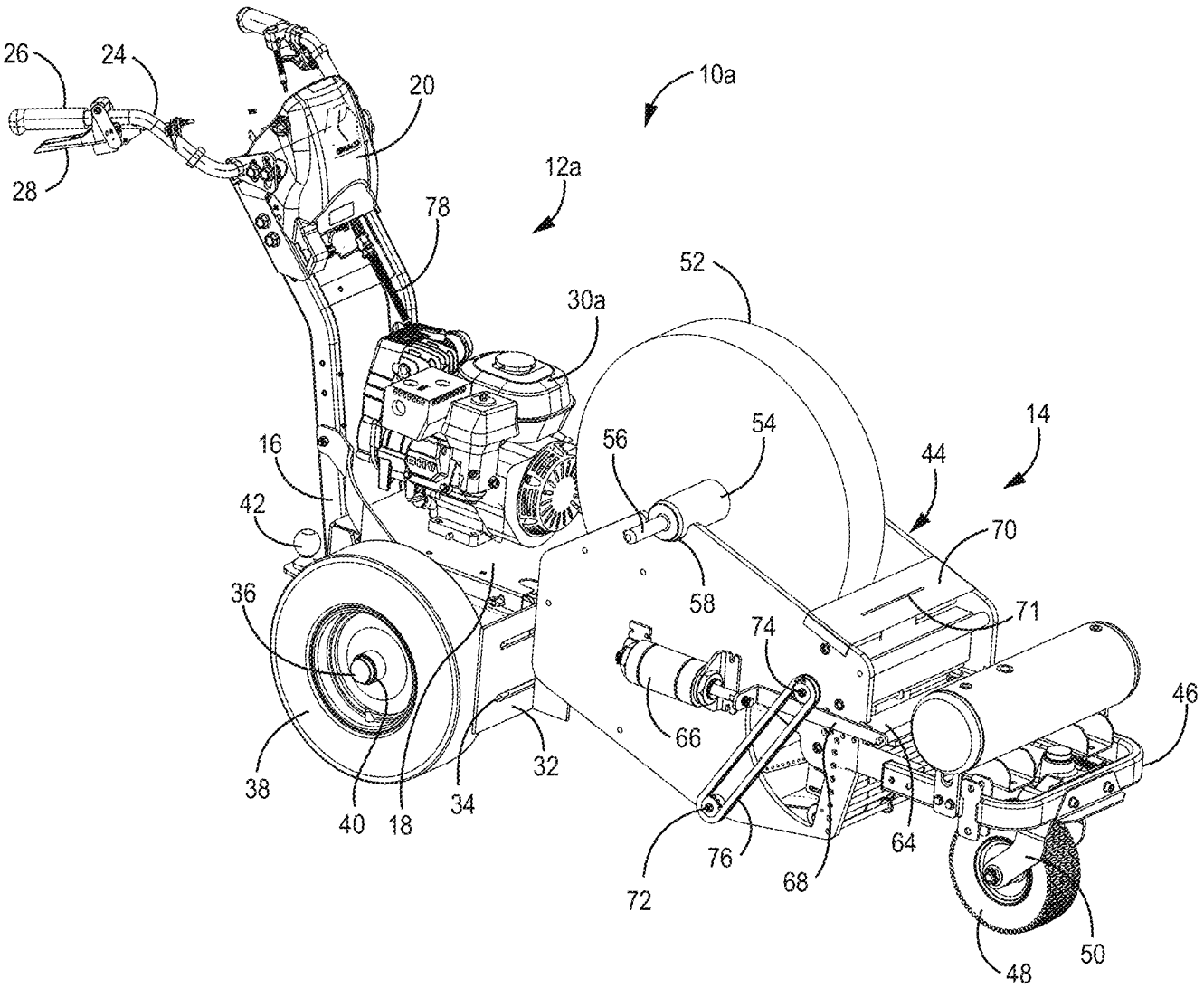
FIG. 1 is a perspective view of one embodiment of a road taping machine.

While the above-identified figures set forth one or more embodiments of the present disclosure, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

[Insert text] Several improvements to a road taping machine are presented herein. The road marking machine is configured to unspool road marking tape from a spool and tamp that tape onto pavement via a tamping roller. Tape is cut using a blade assembly, and aligned with several alignment rollers. A pivot arm is introduced below that permits a subset of the alignment rollers to displace, allowing slack in the tape to be taken in during cutting such that taping can occur continuously, despite cuts. The spool is housed on an axle anchored to a support arm that can be actuated between an elevated position for loading, and a depressed position for taping. A taping section of the machine is laterally displaceable relative to a drive section via a displacement plate, to permit taping of laterally remote locations. The machine can support multiple spools, including spools with tape paths that bypass the blade assembly.

Figure 2:
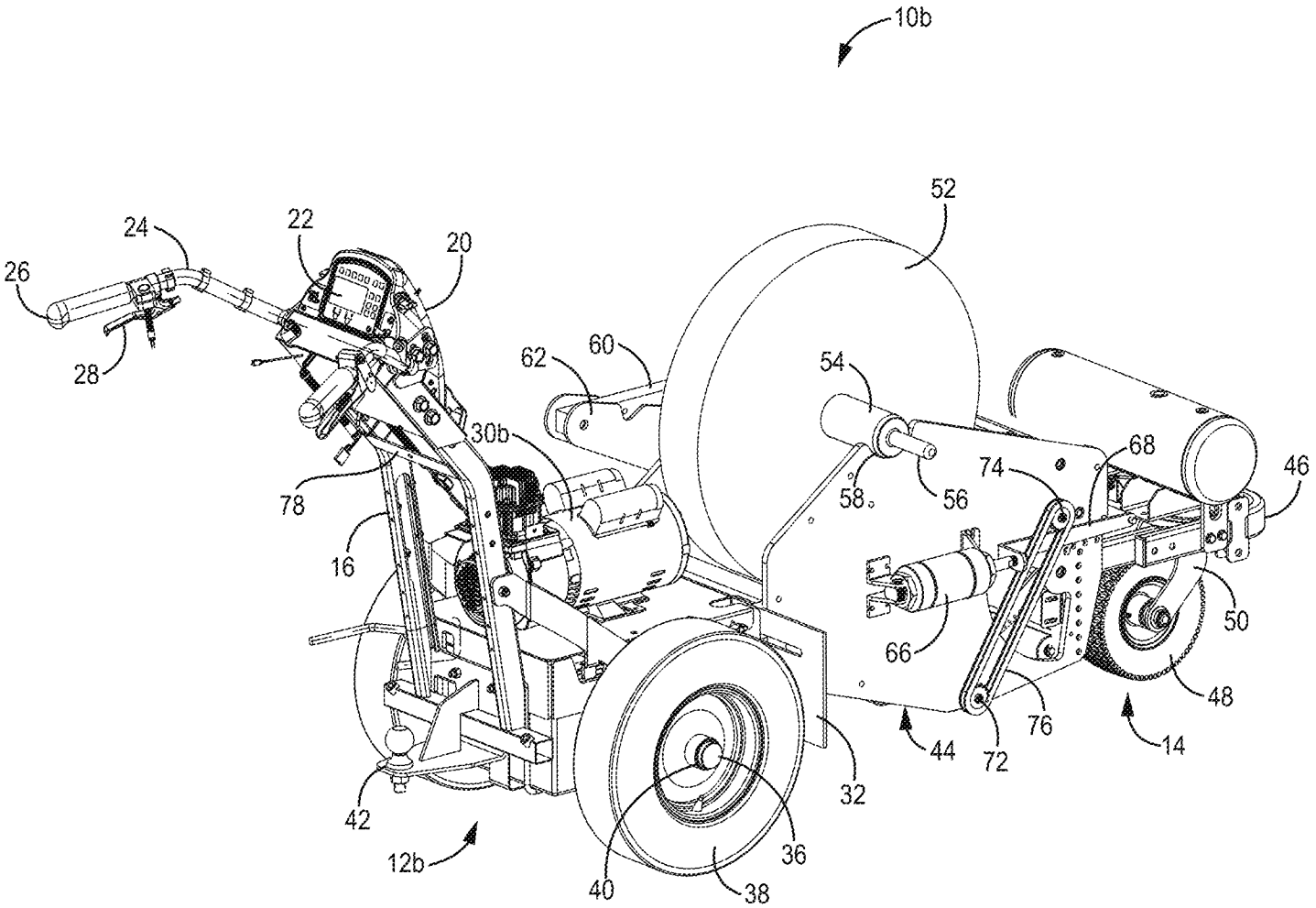
FIG. 2 is a perspective view of another embodiment of a road taping machine.

FIGS. 1 and 2 are perspective views of road taping machines 10*a* and 10*b*, respectively. Road taping machines 10*a* and 10*b* are gas and electrical embodiments, respectively, of a general architecture referred to hereinafter as road taping machine 10. Except where indicated below, road taping machines 10*a* and 10*b* are described together, and the various improvements disclosed below should generally be assumed to applicable to both gas road taping machine 10*a* and electrical road taping machine 10*b*. Although only gas and electrical embodiments are illustrated here, road taping machine 10 can more generally be any gas, electric, or hybrid system without departing from the scope and spirit of the present disclosure.

Road taping machine 10 consists of a variety of components situated either in drive section 12 (12*a* for gas road taping machine 10*a*, 12*b* for its electric counterparts 10*b*) or in taping section 14. These sections are partially arbitrary; some components (e.g. motor 30; see below) can in alternative embodiments be situated in either section. In general, taping section 16 includes the all components dedicated to the handling of the road marking tape, while drive section 14 includes wheels, handlebars, tow connections, and other means for stabilizing and driving road taping machine 12. Other components can optionally be located in either section. A human operator interacts with road taping machine 10 primarily via drive section 12 while laying tape, and with taping section 14 primarily when switching out or feeding in new tape spools. Components are distributed throughout sections 12 and 14 of road taping machine 10 such that an operator at the head of drive section 12 has a clear view of pavement in the target taping area, as unobstructed by components of road taping machine 10 as possible. Several components and systems of both drive section 12 and particularly taping section 14 are described in greater detail below alongside later figures.

In the illustrated embodiment drive section 12 includes drive subframe 16, bed box 18, controller 20 (with operator interface 22), handlebars 24 (with grips 26 and brake pulls 28), motor 30 (30*b* is a gas motor; 30*a* an electric motor), offset plate 32 (with offset slots 34), drive axle 36, rear wheel 38, wheel encoder 40, and tow connector 42. Controller 20 is shown connected to motor 30 via connector 78.

Drive subframe 16 and bed box 18 together form a rigid support structure for other components of drive subframe 16. Bed box 18 carries motor 30, and can in some embodiments enclose a variety of other components not shown in FIGS. 1*a* and 1*b*, including energy storage devices (e.g. batteries), pneumatic tanks, and additional electronics and electrical connections to controller 20. Drive subframe 16 extends from bed box to support operator-side components of drive subframe 16. These components include controller 20, a logic-capable device configured to provide a human operator with information and input means via operator interface 22. Controller 20 and operator interface 22 can, for example, record and display tape usage, distance covered, distance remaining, and other relevant parameters to a human operator engaged in laying road tape. In some embodiments, controller 20 and operator interface 22 can also alert an operator to possible fault conditions, or assist with aligning road taping machine 10 along a target path.

Handlebars 24 allow a human operator to push or guide road taping machine 10 using grip 26 and brake 28, which are illustrated as bicycle-style grips and brake pulls. In the illustrated embodiment, brake pulls 28 need not serve functions related to braking. In some embodiments, one brake pull 28 can be used to allow manual engagement of uptake bar 86 with uptake roller 96 to cause tape to be drawn into the taping apparatus of taping machine 10, as discussed in greater detail below with respect to FIGS. 3-7. In a further embodiment, a brake pull 28 actuates caster mount 50 to either unlock or pivot the caster. This functionality can, for example, be used to lift or cant roller 106 off the ground, e.g. to move road taping machine 10 without applying tape, as discussed in greater detail below.

In some embodiments, road taping machine 10 can be driven by a vehicle attachable via tow connector 42, as an alternative to using handlebars 24. In the most general case, road taping machine 10 can be a powered system driven by motor 30, or a system instead driven by a human operator or by a separate tow vehicle. Connector 78 is an electrical connector illustrated in FIGS. 1 and 2 as connecting controller 22 to motor 30. More generally, connector 78 can connect to motor 30 and/or components within bed box 18, either directly or indirectly, to provide power and signal connections to controller 20.

In the illustrated embodiment, taping section 16 includes taping box 44, caster sub-frame 46, front wheel 48, caster mount 50, tape spool 52, tape spacer 54, tape axle 56, cradle 58, support arm 60, support mount 62, reciprocating blade 64, blade actuator 66, blade shoe 68, splicing table 70, tamping roller wheel 72, uptake roller wheel 74, and belt 76.

Taping box 44 and caster sub-frame 46 together make up the primary support structure of taping section 16. Taping box 44 is a rigid frame or enclosure that carries tape spool 52 and a variety of other components engaged in directing and cutting road marking tape. Taping box 44 is described in greater detail hereinafter. Caster sub-frame 46 a mounting fixture for front wheel 48 via caster mount 50. In the illustrated embodiment, road taping machine 10 rides on three wheels: two rear wheels 38, and one front wheel 48. Rear wheels 38 (also referred to as "drive wheels") can be powered or unpowered wheels, and rotate on drive axle 36. In the illustrated embodiment rear wheels 38 have fixed orientation along a forward, "drive" direction of road taping machine 10. Front wheel 48, by contrast, is shown as a free wheel on caster mount 50, for adjusting the course of road taping machine 10. A person skilled in the art will understand, however, that various feature of the present disclosure can also be adapted to architectures wherein rear wheels 38 have adjustable orientation. FIGS. 1 and 2 schematically illustrate wheel encoder 40 as situated on drive axle 36. In general, however, wheel encoder 40 can be situated at any location suitable for sensing wheel rotation, and thereby travel distance and speed of road taping machine 10. The free rotation of front wheel 48 and its greater distance from controller 20 generally make drive axle 36 and rear wheel 38 preferable as a location to mount wheel encoder 40, but wheel encoder 40 can alternatively be mounted at front wheel 48. Wheel encoder 40 can, for example, be a magnetic or electromechanical encoder, and parameters derived from wheel rotation (e.g. speed, distance) can be reported to an immediate operator via operator interface 22 and/or stored or broadcast for oversight and/or maintenance by other personnel or systems.

Caster mount 50 can in some embodiments be rotated to extend front wheel 48 further from caster sub-frame 46, thereby levering the body of road taping machine 10 away from the ground. This is done to halt contact between the tamping roller (106; see FIG. 5) and the ground, and thereby halt taping while moving the machine to a new location.

Tape is applied to pavement—typically into pre-formed grooves in pavement—by a portion of the weight of road taping system 10 via a tamping roller (discussed in greater detail below) bearing down on tape dispensed beneath road taping system 10 as it moves. Spooled tape is stored on tape spool 52, which can be a replaceable tape spool of a variety of widths, spooled diameters, and thicknesses. All of these dimensions are accounted for by features of taping section 16. Tape spool 52 rotates about tape axle 56, which is in turn anchored to support arm 60. Tape axle 56 can be a freely rotating axle, or can be a fixed rod surrounded by tape spacer 54. In embodiments wherein tape axle is fixed, tape spacer 54 rotates on tape axle 56, together with tape spool 52. In other embodiments, tape spacer 54 and tape axle 56 rotate together. Tape spacer 54 is situated radially between tape axle 56 and tape spool 52. In some embodiments, tape spacer 54 can be a modular component interchangeable with other spacers of different diameters, to support tape spools 52 of different diameters. In other embodiments, tape spacer 54 can be a permanently attached element of taping section 16. As shown in FIGS. 1 and 2, tape axle 56 is anchored to and supported by support arm 60, which is pivotable on support mount 62 as described in greater detail below with respect to FIGS. 3 and 4. In general, support arm 60 is actuatable between an upright spool mounting position and a depressed taping position. FIGS. 1 and 2 illustrate spool 52 and support arm 60 in the taping position, and depict tape axle 56 as supported (via tape spacer 54) on cradle 58 of taping box 44. In general, cradle 58 is a support structure for tape axle 56 situated at least on an opposite side of taping box 44 from support arm 60 and support mount 62 (and in some embodiments on both sides). FIGS. 1 and 2 illustrate cradle 58 as a depression or indentation along a top edge of taping box 44. More generally, however, cradle 58 is a support structure that receives tape axle 58 and/or tape spacer 54 only when support arm 60 is in its depressed taping position.

Figure 5:
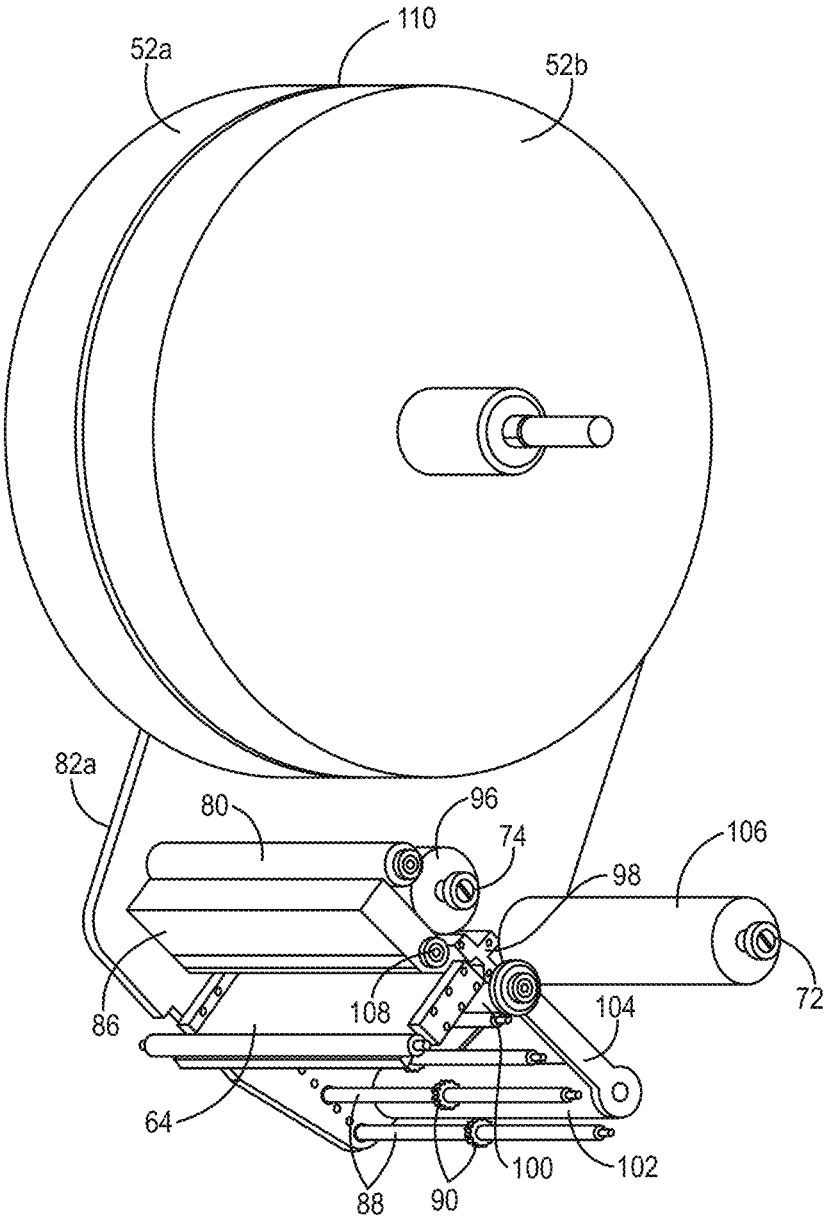
FIG. 5 is a perspective view of a partial assembly of the taping box and adjoining structure of FIGS. 3 and 4, with two tape spools installed within the taping box.
Figure 6:
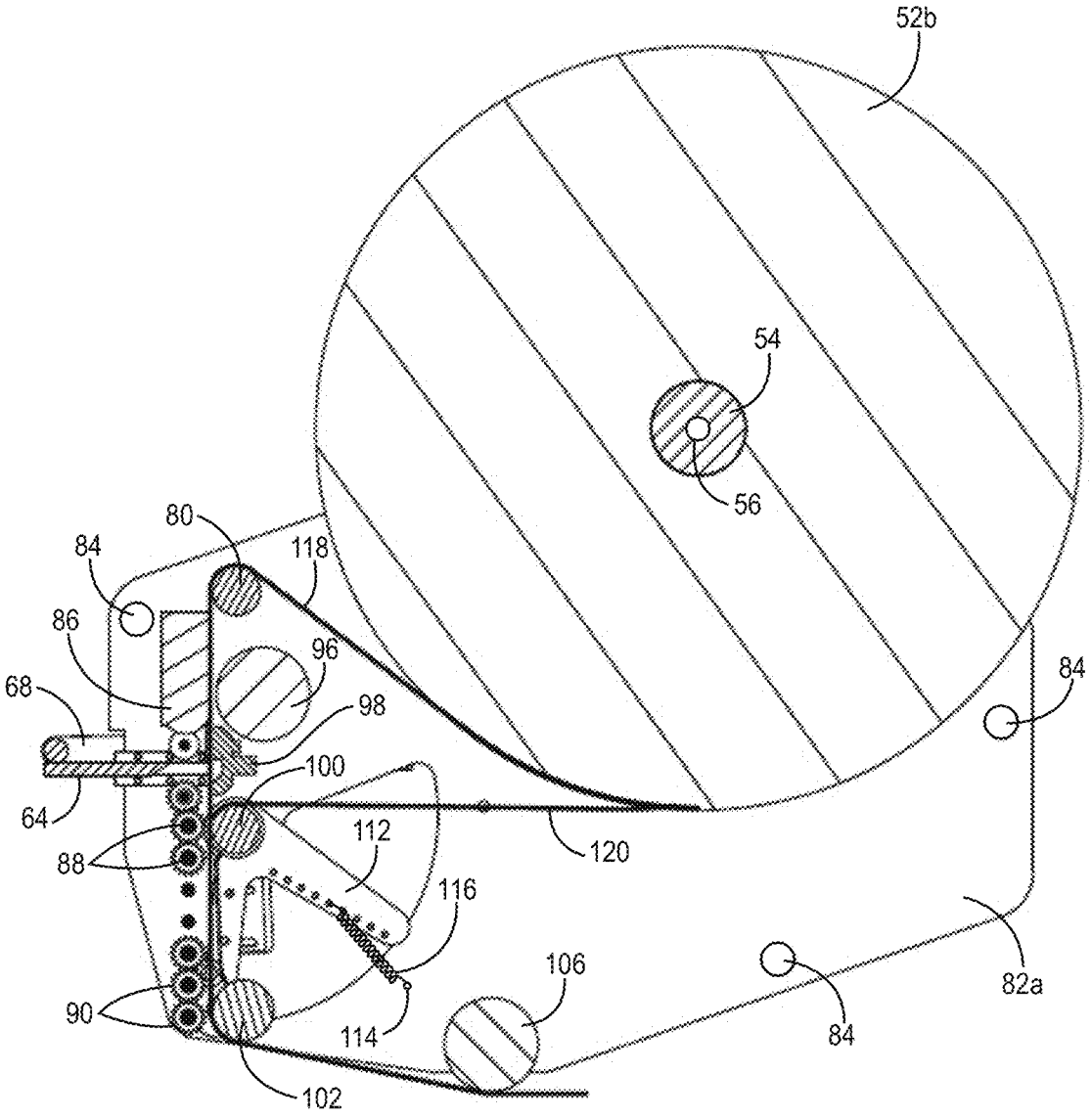
FIG. 6 is a cross-sectional view of the taping box of FIG. 5, illustrating primary and bypass routes of tape from the two tape spools.

Taping section 16 includes reciprocating blade 64 on blade shoe 68, driven by blade actuator 66 as described in greater detail with respect to FIGS. 5 and 6. Tape from tape spool 52 can follow a tape path through the front of taping box 44, along several rollers, through reciprocating blade 64. Blade actuator 66 drives reciprocating blade 64 to cut tape at desired lengths. Blade actuator 66 can, for example, be a pneumatically, electrically, or mechanically driven reciprocating actuator driven by motor 30 (connections to motor 30 are not shown in FIGS. 1 and 2, for readability of the figures, but can generally be compliant cables or tubes.

Taping section 16 also includes splicing table 70, as shown in FIG. 1. Splicing table 70 is a flat platform or pedestal disposed along the tape path from spool 52 to reciprocating blade 64. During operating of road taping machine 10, it can be necessary to splice together separate sections of tape to be applied to a pavement surface. This is particularly common when joining the last tape from one spool with the first tape of the next spool to form a continuous tape line. Splicing table 70 facilitates splicing by providing a rigid backing along the non-adhesive side of the tape path into the intake rollers and blade assembly of taping section 16. Tape to be spliced can be laid flat on splicing table 70, obviating the need for an operator to juggle two pieces of (sticky, awkward) tape while performing a splice. In some embodiments, splicing table 70 can include a groove or slot 71 oriented generally transverse to the path of the tape, as a cutting guide to assist the operator in obtaining square cuts, e.g. for cleanly matched tape ends to splice together.

Taping section 16 also supports tamping roller wheel 72 and uptake roller wheel 74. Tamping roller wheel 72 and uptake roller wheel 74 are connected by belt 76, and are described in greater detail below with respect to FIGS. 5 and 6.

Figure 8A:
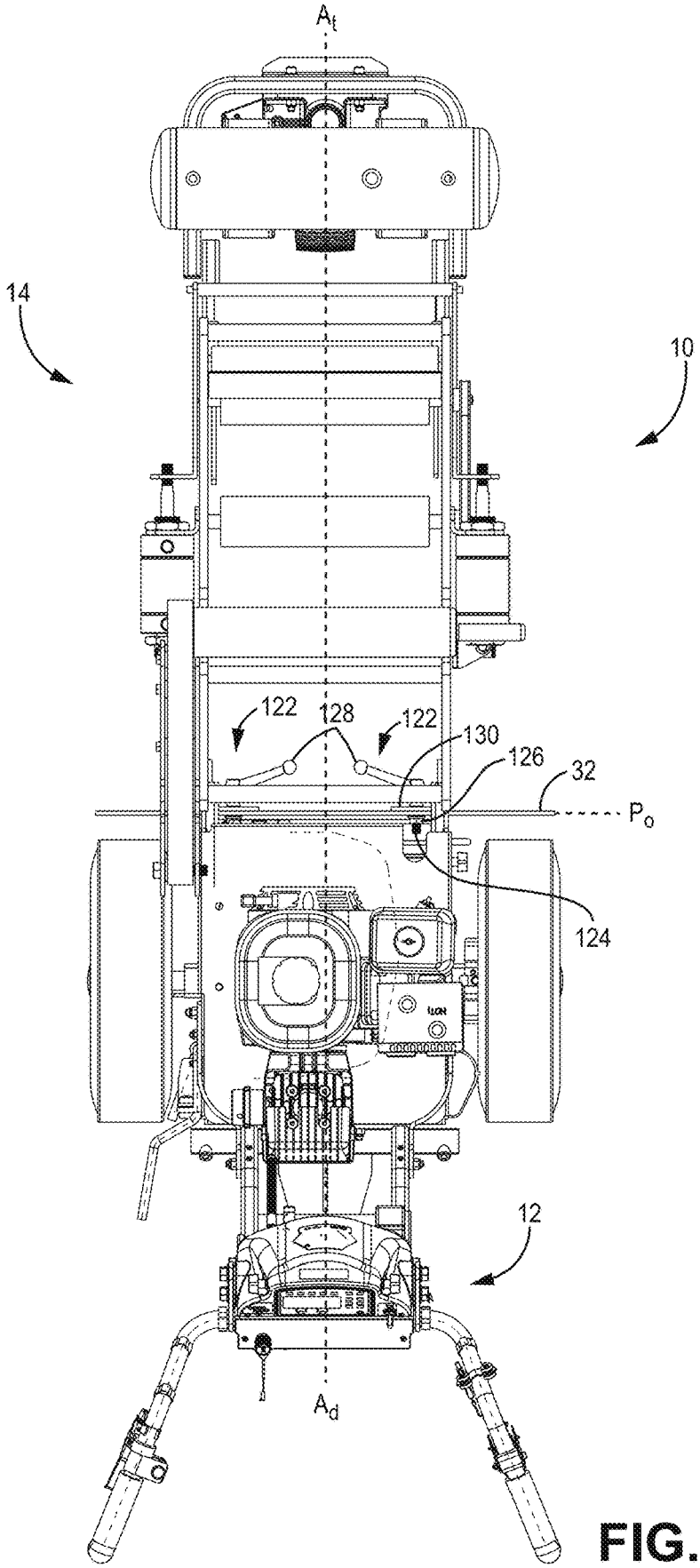
FIGS. 8A and 8B are overhead views of the road taping machine of FIG. 1, illustrating alternative positions of the taping box adjustable via an offset plate.
Figure 8B:
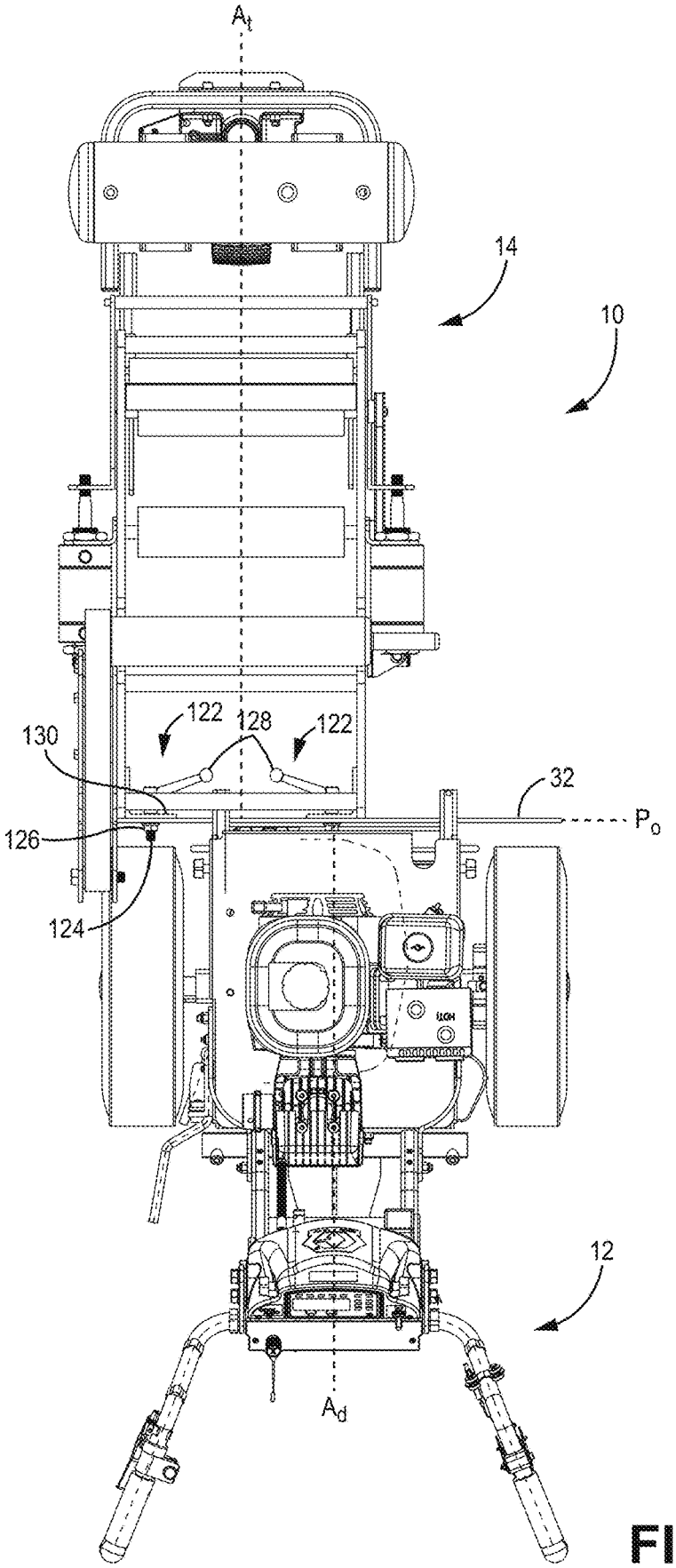

Offset plate 32 forms a part of a displacement mechanism described in greater detail with respect to FIGS. 8A and 8B, and connects drive section 14 with taping section 16. Drive section 14 and taping section 16 are only rigidly attached to each other this displacement mechanism; all other connections extending between drive section 14 and taping section 16 are compliant (e.g. hoses, cables). As described in greater detail below, the illustrated embodiment of taping section 16 is connected to drive section 14 via fasteners disposed through offset slots 34, which extend laterally across at a portion of offset plate. By adjusting this connection, taping section 16 can be displaced laterally with respect to 14, enabling taping of areas that would otherwise be impossible to reach due to the width of the wheel base of drive section 14. Road taping machine 10 extends primarily along a drive axis parallel, in the illustrated embodiments, to a fixed orientation of rear wheels 38. For all embodiments, including embodiments wherein rear wheels 38 are not fixed, this "drive axis" should be conceived as extending in a rear-to-forward direction substantially parallel to sides of taping box 44 (walls 82*a*, 82*b*; see FIG. 3 and accompanying description). As used throughout herein, the terms "lateral" and "laterally" are affirmatively defined as referring to a direction orthogonal to the taping axis.

Figure 3:
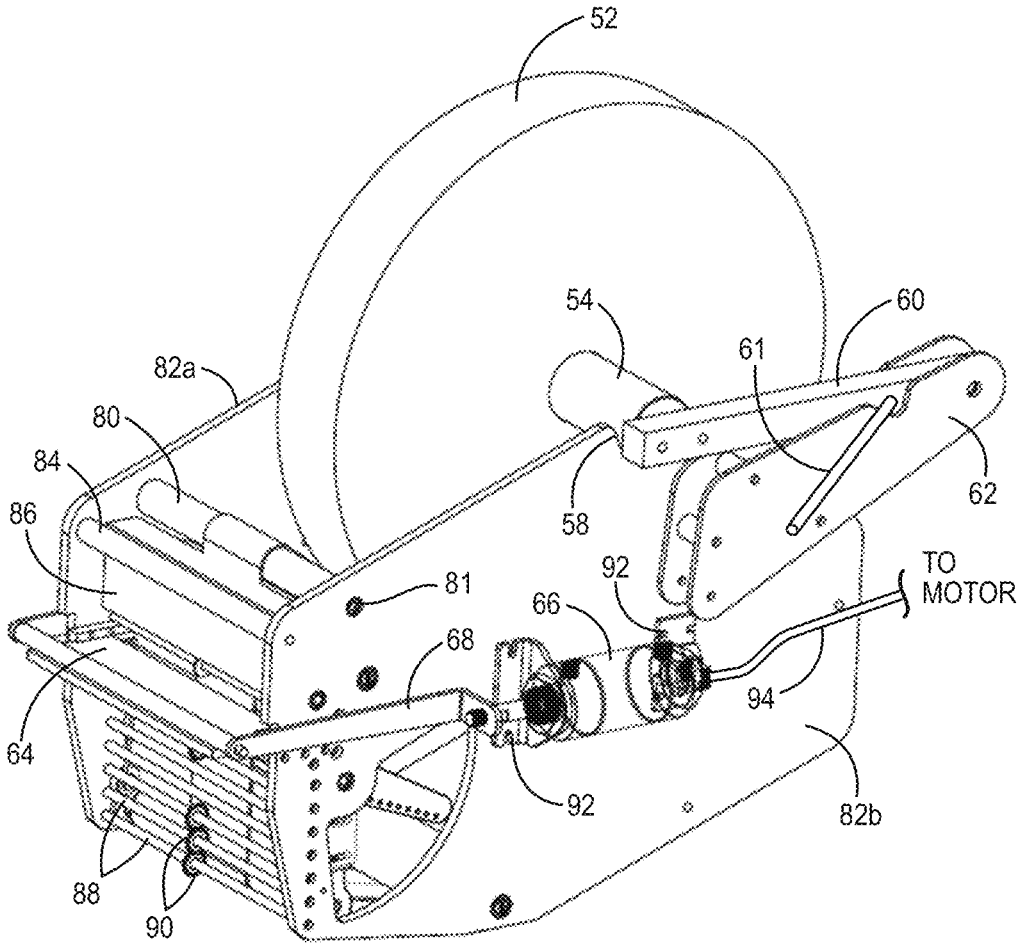
FIG. 3 is a perspective view of a taping box and adjoining structure from the road taping machine of FIG. 1 or 2.
Figure 4:
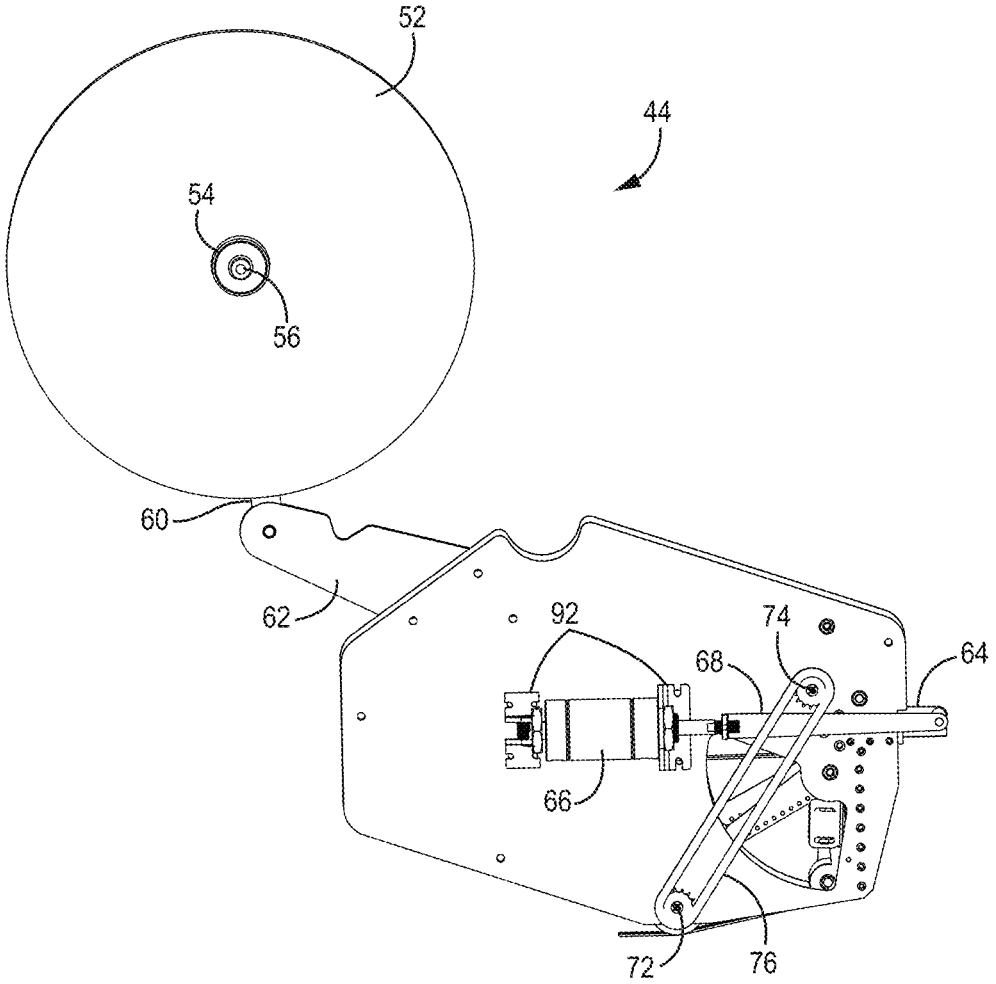
FIG. 4 is a side view of the taping box and adjoining structure of FIG. 3, illustrating a lever arm in an installation position.
Figure 7:
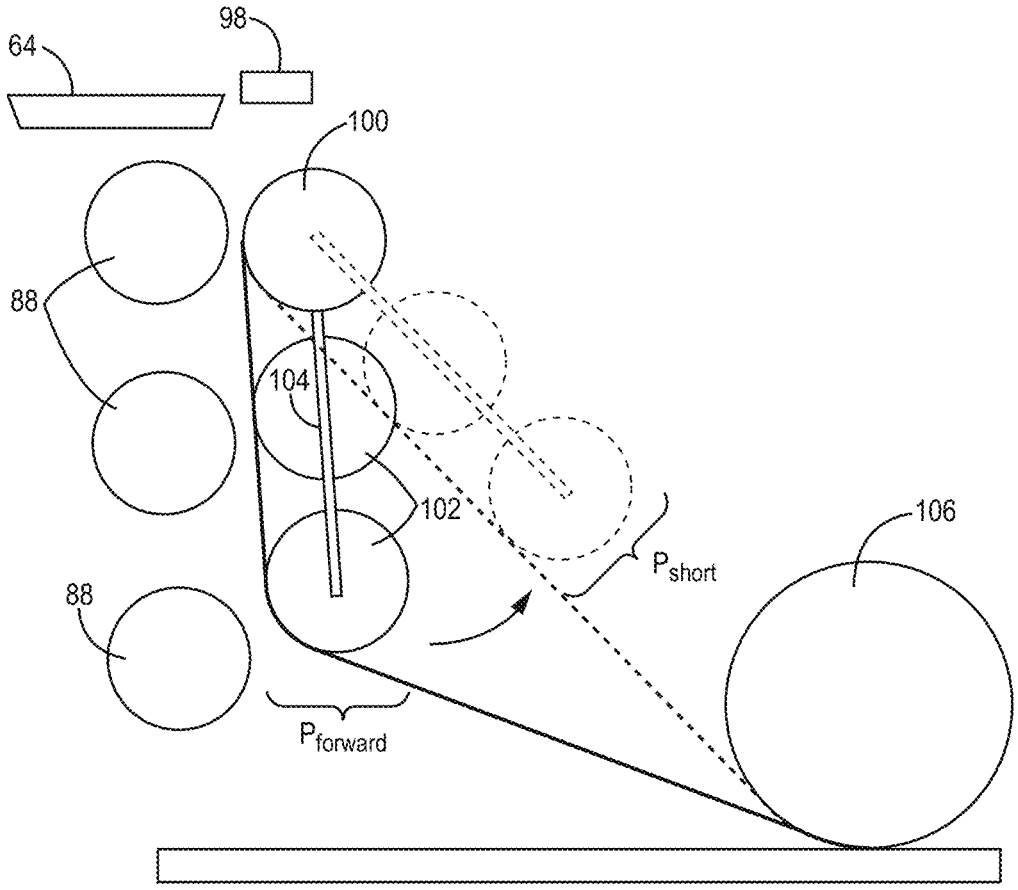
FIG. 7 is a schematic cross-sectional view of a spring-loaded pivot system for the taping box of FIGS. 5 and 6.

FIGS. 3 and 4 are perspective and side views, respectively, of the exterior of a portion of road taping machine 10 including and centered on taping box 44. FIG. 3 illustrates support arm 60 in its depressed taping position, while FIG. 4 illustrates support arm 60 in its elevated loading position. FIGS. 5, 6, and 7 are perspective, cross-sectional, and schematic views, respectively, of the interior of the same portion of road taping machine 10. FIGS. 3-7 are described together. FIGS. 5 and 6 differ from FIGS. 3 and 4 in that they depict multiple spools (52*a*, 52*b*) riding on tape axle 56. These different spools can feed tape along different paths, including a bypass path that avoids reciprocating blade 64, as described below.

FIGS. 3-7 variously illustrate tape spool 52, tape spacer 54, cradle 58, support arm 60, dampener 61, support mount 62, reciprocating blade 64, blade actuator 66, blade shoe 68, tamping roller wheel 72, uptake roller wheel 74, and belt 76, all as described above with respect to FIGS. 1 and 2. FIGS. 3-7 additionally show intake roller 80, box walls 82*a* and 82*b*, structural bar 84, uptake bar 86, adhesive-side rollers 88 (with star washers 90), brackets 92, motor connection 94, uptake roller 96, fixed blade 98, fixed non-adhesive-side roller 100, pivoting non-adhesive-side roller(s) 102, roller pivot arm 104, tamping roller 106, bar pivot 108, axial spool spacer 110, roller bias arm 112, spring attachment point 114, spring 116, primary tape path 118, and bypass tape path 120.

In the illustrated embodiment, taping box 44 is formed primarily of two rigid side walls 82*a* and 82*b* (collectively side walls 82) disposed parallel to and on opposite sides of spool 52 (or spools 52*a*, 52*b* when multiple spools are present). Side walls 82 either directly or indirectly anchor all of the tape handling rollers and blades of taping section 16. Side walls 82 rigidly connected by a several structural bars 84 (one of which is visible in FIG. 3; three in FIG. 6). Intake roller 80, uptake bar 86, uptake roller 96, tamping roller 106, and various tape alignment rollers (adhesive-side rollers 88, fixed non-adhesive-side roller 100, and pivoting non-adhesive-side roller(s) 102) are all anchored to side walls 82 either directly or indirectly (for pivoting non-adhesive-side rollers 102), but with at least some degree of freedom with respect to taping box 44.

FIGS. 3 and 4 depicts support arm 60 at the two limits of its rotational freedom. FIG. 3 shows support arm 60 in the depressed taping position. As can be seen in FIG. 3, box wall 82*a* prevents spool 52 from being removed while support arm 60 (and accordingly spool 52) are in this taping position. Removing or installing a spool is only possible while support arm 60 is in its elevated position. In the taping position, support arm 60 collapses towards (i.e. towards parallel with) support mount 62. In the loading position illustrated in FIG. 4, by contrast, the pivot arm is rotated away from (i.e. towards orthogonal to) support mount 62.

Spool 52 is substantially most elevated, i.e. furthest from the bottom of taping box 44, when support arm 60 is in its loading position, thereby providing easy access to the operator at a height suitable for removing or inserting tape spools without bending or crouching. Spool 52 is closest to the bottom of taping box 44, and is supported by cradle 58 of taping box 44, when in the taping position. The comparatively low profile of tape spool 42 in the taping position improves visibility of the target (taping) area ahead of road taping machine 10 from the operator's position at handlebars 24.

Dampener 61 is illustrated schematically as extending between support arm 60 and support mount 62. In alternative embodiments, support arm 60 can be attached between support arm 60 and, e.g., side wall 82. Although dampener 61 is shown in FIG. 3 as attached alongside (i.e. outboard of) support arm 60 and support mount 62, other embodiments of dampener 61 can be disposed within the frame of support arm 62. Dampener 61 can, for example, be a gas piston dampener or other fluid dampener. In general, dampener 61 can have two functions. First, dampener 61 slows the descent of support arm 60 when loaded with spool 52, from the loading position to the taping position. Slowing this descent improves operating safety and protects hardware, and permits better control over the feeding of tape past intake bar 80 (see below). Second, dampener 61 can serve as a restraint on the maximum angular range of support arm 60, defining the loading position. This second function can alternatively or additionally be performed by separate stops. This angular location of the loading position is selected to as to be generally upright, and so that arm 60 is not angled forward in the loading position while road taping machine 10 is on substantially level ground. This positioning ensure that gravity will not tend to drive the raised support arm down into the taping position once it is in the loading position. In some embodiments the angular traverse range of support arm 60 can be slightly further increased so that the loading position is displaced further from intake roller 80, slightly past upright, such that the force of gravity tends to passively retain support arm 60 in the loading position once there. While support arm 60 is in the upright loading position, tape axle 56 is cantilevered away from support arm 60, such that a distal end of tape axle 56 is exposed for removal or installation of spool 52.

Although support arm 60 is depicted in FIGS. 1-4 as situated on a particular side of road taping machine 10 (the left side, specifically, from the point of view of a driving operator), support arm 60 and support mount 62 can be adapted for installation on either side of taping box 44, which can for example include bolt holes or other fastening means permitting support mount 62 to be secured in either location. This ambidextrous mounting scheme is particularly useful when road taping is required on an active road, i.e. when traffic presents a possible hazard to the operator. By allowing support arm 60 to be switched between side of taping box 44, road taping machine 10 facilitates loading and unloading spools from whichever side of the device is furthest from traffic.

Primary tape path 118 defines a route for tape from spool 52 to tamping roller 106 via the cutting blade assembly formed from fixed blade 98 and reciprocating blade 64. Tamping roller 106 presses tape into the ground, and rolls together with the ground when road taping machine 12 is in motion and canted away from the ground by rotation of caster mount 50 (see FIGS. 1, 2, and accompanying description). In this position, a portion of the weight of road taping machine 12 presses through tamping roller 16 to tamp tape into the pavement beneath.

Along primary tape path 118, tape bends around intake roller 80 to pass between uptake roller 96 and uptake bar 86. Uptake roller 80 can, for example, but a freely rotating positioning roller. Uptake roller 96 is coupled to tamping roller 106 by the connection of belt 76 across uptake roller wheel 74 and tamping roller 72, respectively. As tamping roller 106 rotates along the ground, it drives uptake roller 96 through tamping roller wheel 72, belt 76, and uptake roller wheel 74. Thus, uptake roller 96 rotates whenever road taping machine 10 moves along the ground with tamping roller 106 engaged. Tape uptake bar 86 rotates about bar pivot 108, pivoting towards an away from uptake roller 96 as actuated by an external source (not shown) such as a draw cable or pneumatic actuator. This reciprocation of tape uptake bar 86 forces tape into contact with uptake roller, causing it to be drawn into the machine's cutting assembly (reciprocating blade 64 and fixed blade 98). Although uptake bar 86 is illustrated in simplified form in FIGS. 5 and 6 as a solid structure, it can include star washers as described below with respect to adhesive-side rollers 88 to avoid sticking to tape. Uptake bar 86 and uptake roller 96 cooperate to ensure that tape flow along primary tape path 118 does not halt when tape is cut. In at least some embodiments, as discussed above with regard to FIGS. 1 and 2, uptake bar 86 can be additionally actuatable by a human operator by squeezing brake pull 28. In some such embodiments, for example, actuating brake pull 28 pulls uptake bar 86 towards uptake roller 96, e.g. via a mechanical connection such as a gear train or draw cable, or indirectly via electronic triggering of a separate actuator. This manual actuation method can be combined with automated uptake actuation governed by controller 20, in some embodiments.

Tape following primary tape path 118 next passes between reciprocating blade 64 and fixed blade 98. Fixed and reciprocating blades 98 and 64, respectively, form a cutting assembly wherein fixed blade 98 serves as a sharply edged rigid receiver for reciprocating blade 64. Reciprocating blade 64 is displaced by blade actuators 66 under the control of controller 20, as driven by motor 30 through actuator drive connection 94. In some embodiments blade actuators 66 can be air cylinders actuated according to control by controller 20, and pressurized by motor 20. In other embodiments, blade actuators 66 can be drive rods directly coupled to motor 30 via a drive train. In some embodiments one or both blades can be treated with polytetrafluoroethylene coatings, hydrophobic or oleophobic coatings, or with other anti-adhesive coatings to prevent tape from adhering to the blades. In the illustrated embodiment reciprocating blade 64 faces the adhesive side of tape following primary tape path 118, and so particularly benefits from anti-adhesive coatings. Alternatively, one or both blades can be wetted with oil or solvent. The timing of cuts by reciprocating blade 64 can, for example, be aligned with distance traveled as reported by wheel encoder 40, or with tape dispensed as reported by encoder 81 metering the length of tape dispensed. Although encoder 81 is shown on intake roller 80 (see FIG. 3), it can more generally be situated at any location indicative of tape movement or reduction in spool thickness, such as on tape axle 56, or on tape spool 52. Encoder readings reflecting amount of tape dispensed, or distance traveled while applying tape, can also be processed and/or gathered by controller 20 to generate indications when tape level is low.

Past blades 64 and 98, primary tape path 118 is retained between adhesive-side rollers 88 and non-adhesive-side rollers including fixed non-adhesive side roller 100 and at least one pivoting non-adhesive-side roller 102. Adhesive-side rollers 88 abut the adhesive side of road marking tape threaded through primary tape path 118, and prevent tape from bowing forward or escaping taping box 44. Non-adhesive-side rollers 100 and 102 abut the opposite, non-adhesive side of the road making tape, and retain it at a distance from tamping roller 106, as described in greater detail below.

Adhesive-side rollers 88 are narrow rotating bars each provided with at least one star washer 90. In some embodiments, each adhesive-side roller 88 includes a plurality of star washers 90 distributed across the lateral width of taping box 44, between side walls 82. Adhesive-side rollers 88 exert retaining force on tape only or primarily through star washers 90, so as to minimize surface area in direct contact with tape adhesive, and thus reduce the risk of adhesion to the rollers. Non-adhesive-side rollers 100 and 102 do not require star washers.

As shown in FIGS. 6 and 7, fixed non-adhesive-side roller 100 receives tape along primary tape path 118 from blades 64 and 98. At least one pivoting non-adhesive-side roller 102 is disposed further along the primary tape path to tamping roller 106, and supported between two parallel pivot arms 104 situated at either lateral end of pivoting non-adhesive-side rollers 102. FIG. 7 shows two pivoting non-adhesive-side rollers, while FIGS. 5 and 6 show only one. More generally, any appropriate number of rollers sufficient to define an inner board of the tape path can be used. Pivot arms 104 can, as shown in FIG. 7, be pivotable about the axis of rotation of fixed non-adhesive-side roller 100, but can alternatively be pivotable elsewhere. In the most general case, pivot arms 104 can be rotate with respect to any fixed mounting on taping box 44 that permits pivoting non-adhesive-side rollers 102 to pivot between a forward position Pforward and a shortened path position Pshort. In forward position Pforward, tape is retained generally close to or against adhesive-side rollers 88. In shortened path position Pshort, tape can draw away from adhesive-side rollers 88, and the overall tape path length from the blade assembly to tamping roller 106 is reduced.

FIG. 6 depicts roller bias arm 112, a lever arm integral with or attached to at least one pivot arm 104. Spring 116 is a biasing element stretched between a roller bias arm 112 and a spring attachment point 114 that can, for example, be generally proximate to tamping roller 106. Including a corresponding roller bias arm 112 and a spring 116 with each pivot arm provides more uniform load distribution and avoids deflection of relative twisting of the bias arms.

During normal unspooling of tape from spool 52 unimpeded to tamping roller 106, pivot arm 104 remains in or close to forward position Pforward. While reciprocating blade 64 and fixed blade 98 are cutting tape, however, the tape is clamped between the two blades and cannot flow. This period while the blades are clamped together but before the tape is cut defines a short interval in which road taping machine 10 would need to slow or stop, but for the slack offered by the extra path length provided by P-forward relative to Pshort. During this interval, tamping roller 106 continues to draw in tape, pulling pivoting non-adhesive-side rollers 102 back towards shortened path position Pshort and rotating pivot arm 104 to take in this slack. When the cut finishes, spring 116 biases pivoting non-adhesive-side rollers 102 back in to forward position Pforward. In this way, road taping machine 100 is able to continuously cut and tamp into place segments of tape while moving at up to speeds in excess of 5 mph, without pause.

During operation, the range of motion of pivoting non-adhesive-side rollers 102 with pivot arm 104 determines a total amount of slack S that can be taken in while cutting. The process of cutting tape with blades 64 and 98 is characterized by a cut duration D (e.g. 0.3 seconds) from start to end of each cut, with that duration D determined, among other parameters, by the sharpness and force of relative action of the two blades. The speed at which road taping machine 10 can travel while cutting, accordingly, is at least partially determined by this extra slack, with speed v=S/D. Although other design parameters can also contribute somewhat to slack, and to the machine's ability to tape while moving, the addition of rollers 102 along pivot arm 104 permits significantly faster movement while taping.

Tape can be threaded along primary tape path 118 without being cut, if so desired, simply by not actuating reciprocating blade 64. In some instances, however, it can be desirable to simultaneously apply tape from two spools, only one of which should be cut. For example, road markings with parallel solid and dashed lines are commonly used to denote allowed lane changes (e.g. for passing) only for traffic in one direction. The present system is capable of supporting multiple spools of road marking tape on tape axle 56. In some embodiments, axial spool spacer 110 can be placed between spools 52*a*, 52*b* to provide a desired fixed separation between road marking lines. Although only two separate spools 52*a* and 52*b* are illustrated in FIG. 5, greater numbers of parallel tape spools are also possible. If a continuous line of tape is to be laid parallel to an interrupted (e.g. dashed) line, tape from the spool designated for the uninterrupted line can be routed through bypass tape path 120. As illustrated in FIG. 6, bypass tape path 120 bypasses blades 64 and 98, but can in the illustrated embodiment follow tape alignment rollers 88, 100, and 102 to tamping roller 106. In the most general case, bypass tape path 120 can follow any route from spool 52*a* or 52*b* to tamping roller 106 that avoids tape fouling, and retains relative tape positioning.

FIGS. 8A and 8B provide overhead views of road taping machine 10 directed at the displacement mechanism of offset plate 32, as briefly described above with respect to FIGS. 1 and 2. As noted above, this displacement mechanism allows taping section 16 to be displaced laterally (i.e. in a direction orthogonal to the taping drive direction) with respect to drive section 14. FIG. 8A illustrates taping section 16 aligned with drive section 14. FIG. 8B illustrates taping section 16 displaced to the left (from the perspective of an operator at handlebars 24) relative to drive section 14. This displacement mechanism further includes fasteners 122 (with bolts 124, nuts 126, and lever nut connectors 128) and receiver plates 130. In the illustrated embodiment, receiver plates 130 are rigid support flanges of taping box 44, and bolts 124 pass through both offset slots 34 (see FIG. 1) and apertures in receiver plate 130. Bolts 124 can equivalently be rods or screws. In the illustrated embodiment offset plate 32 and receiver plate 130 are clamped between nuts 124 and lever nut connectors 128. Lever nut connectors 128 can be twisted or pulled between open (loose) and closed (tight) positions, thereby respectively permitting or preventing relative displacement of receiver plate 32 relative to offset plate 130, and of bolts 124 along offset slots 34. Other fastening means can be used in place of lever nut connectors 128 and/or nuts 126. Any clamping fastener capable of securing a receiver plate 130 to an offset plate 32 can suffice, although fastening means that are easily toggled between loosened and tightened states from outside above and outside the taping box, as in the illustrated embodiment, are desirable.

FIGS. 8A and 8B identify tape section axis At, drive section axis Ad, and offset plane Po. Tape section axis At and drive section axis Ad are centerline axes of the taping section 16 and drive section 14, respectively, and are parallel to the drive axis along which road taping machine 10 as a whole is aligned and drives, as previously defined. Offset plane Po is a plane through offset plate 32, and parallel to receiver plate 130. In the illustrated embodiment, offset plane Po is perpendicular to both tape section axis At and drive section axis Ad, although alternative embodiments wherein offset plane Po is skewed relative to axes At and Ad are also contemplated herein. In the most general case, the present displacement mechanism permits offset plate 32 and receiver plate 130 to displace relative to each other along offset plane Po, thereby shifting tape section axis At relative to drive section axis Ad. Tape section axis At and drive section axis Ad always remain parallel to each other, but can be laterally displaced relative to each other as set forth above.

Tape can be installed at any lateral position along the spool axle, which permits a degree of flexibility with respect to the lateral location of the tape. When tape is required in close proximity to walls, curbs, and other barriers, however, the width of drive section 12 (defined by the spacing of rear wheels 38) can make merely shifting spool 52 to one end of spool axle 56 inadequate to allow taping. In such confined conditions, the ability to laterally shift the entire taping section to one side or another relative to the drive section can permit taping where operation would otherwise be impossible.

DISCUSSION OF POSSIBLE EMBODIMENTS

The following are non-exclusive descriptions of possible embodiments of the present invention.

A road taping machine configured to carry and apply road marking tape to pavement, the road taping machine comprising: a spool mount disposed to receive a spool of the road marking tape; a tamping roller configured to receive the road marking tape from the spool, and force the road marking tape into the pavement; a blade assembly disposed between the spool mount and the tamping roller, the blade assembly configured to cut the road marking tape; a plurality of positioning rollers disposed between the blade assembly and the tamping roller and configured to retain one side of the road marking tape between the blade assembly and the tamping roller; and a pivot arm disposed to support a subset of the positioning rollers, thereby permitting at least one of the plurality of positioning rollers to deflect while the blade assembly cuts the road marking tape, such that a tape path along the plurality of positioning rollers to the tamping roller is reduced.

The road taping machine of the preceding paragraph can optionally include, additionally and/or alternatively, any one or more of the following features, configurations, and/or components:

A further embodiment of any of the foregoing road taping machines, wherein permitting at least one of the plurality of positioning rollers to deflect while the blade assembly cuts the road marking tape comprises allowing the pivot arm to rotate towards the tamping roller, the road taping machine further comprising a rotatable arm extending from a pivot towards the tamping roller.

A further embodiment of any of the foregoing road taping machines, further comprising a biasing spring configured to drive the plurality of positioning rollers towards a position further from the tamping roller when not constrained by reduction of slack in the road marking tape between the blade assembly and the tamping roller.

A further embodiment of any of the foregoing road taping machines, further comprising a structural frame supporting the spool mount, the blade assembly, the pivot, and the tamping roller, wherein the biasing spring extends from the structural frame to the pivot arm.

A further embodiment of any of the foregoing road taping machines, wherein pivot arm has a V-shaped profile, with a first leg of the V-shaped profile carrying the plurality of positioning rollers, and a second leg of the V-shaped profile attached to the biasing spring.

A further embodiment of any of the foregoing road taping machines, further comprising a tape intake roller disposed between the blade assembly and the spool mount.

A further embodiment of any of the foregoing road taping machines, further comprising a rotational coupling between the tape intake roller and the tamping roller.

A further embodiment of any of the foregoing road taping machines, wherein the blade assembly comprises a first blade and a second blade configured to clamp together to cut the road marking tape, such that the road marking tape is held by the blade assembly while being cut, and slack in the road marking tape between the blade assembly and the tamping roller is taken in via the deflection of the subset of the positioning rollers.

A method of dispensing sections of road marking tape to pavement via a road taping machine, the method comprising: unspooling the road marking tape from a spool, through a blade assembly, to a tamping roller that forces the road marking tape into the pavement via the weight of the road taping machine; cutting the road marking tape using the blade assembly; retaining the road marking tape in engagement with a plurality of positioning rollers in first positions along a path between the blade assembly and the tamping roller; and displacing a subset of the plurality of positioning rollers toward second positions closer to the tamping roller, while cutting the road marking tape, thus shortening the path; and displacing the subset of the plurality of positioning rollers back into the first position once the road marking tape has been cut.

The method of the preceding paragraph can optionally include, additionally and/or alternatively, any one or more of the following features, configurations, and/or components:

A further embodiment of the foregoing method, wherein displacing the subset of the plurality of positioning rollers comprises rotating a pivot arm to which the subset of the plurality of positioning rollers is attached.

A further embodiment of any of the foregoing methods, wherein displacing the subset of the plurality of positioning rollers back into the first position comprises biasing the pivot arm towards the first position with a spring, such that the subset of the plurality of positioning rollers rests at the first position when not forced toward the second position by reduction of slack in the road marking tape between the blade assembly and the tamping roller.

A further embodiment of any of the foregoing methods, wherein cutting the road marking tape using the blade assembly comprises first clamping then shearing the road marking tape between a first blade and a second blade.

A further embodiment of any of the foregoing methods, wherein the displacing of the subset of the plurality of positioning rollers toward the second positions occurs while the road marking tape is clamped between the first and second blades, and before the road marking tape is sheared by the first and second blades.

A further embodiment of any of the foregoing methods, further comprising advancing the road taping machine along the pavement continuously through multiple iterations of unspooling, cutting, and applying the tape to pavement.

A road taping machine disposed to apply road marking tape from a spool into pavement via a tamping roller, the road taping machine comprising: a blade assembly disposed between the spool and the tamping roller to cut the road marking tape; and a tape alignment roller disposed between the blade assembly and the tamping roller to retain the road marking tape therebetween; wherein the tape alignment roller is movable to shorten a tape path between the blade assembly and the tamping roller.

The method of the preceding paragraph can optionally include, additionally and/or alternatively, any one or more of the following features, configurations, and/or components:

A further embodiment of the foregoing road taping machine, further comprising: a structural frame supporting the spool, the tamping roller, and the blade assembly; and a first pivot arm supporting the tape alignment roller, the first pivot arm rotatably anchored to the structural arm and pivotable between a first position and a second position, the first position defining a longer tape path between the blade assembly and the tamping roller than the second position.

A further embodiment of any of the foregoing road taping machines, further comprising a first biasing element disposed to bias the first pivot arm towards the first position, away from the second position.

A further embodiment of any of the foregoing road taping machines, wherein the first biasing element is a spring connected between the first pivot arm and the structural frame.

A further embodiment of any of the foregoing road taping machines, further comprising a plurality of stationary rollers disposed between the spool and the tape alignment rollers, the stationary rollers being affixed to the structural frame.

A further embodiment of any of the foregoing road taping machines, further comprising: a second pivot arm parallel to the first pivot arm, wherein the tape alignment roller is supported between the first and second pivot arms, such that first and second pivot arms rotate together to define the first and second positions; and first and second biasing elements disposed symmetrically on the first and second pivot arms, respectively, to cooperatively bias the tape alignment roller towards a position of greatest tape path length between the cutting assembly and the tamping roller.

A road taping machine comprising: a rigid frame supported at a bottom side by a plurality of wheels, and extending along a centerline axis; a tape spool axle carried on the rigid frame, and configured to receive and rotatably support a replaceable spool of road marking tape; and a spool loading assembly anchored to the rigid frame and the tape spool axle, and adjustable between: a taping position wherein the tape spool is not removably from the tape spool axle; and a loading position wherein the tape spool is further from the wheels than in the taping position, and wherein the tape spool is removable from the tape spool axle.

The road taping machine of the preceding paragraph can optionally include, additionally and/or alternatively, any one or more of the following features, configurations, and/or components:

A further embodiment of the foregoing road taping machine, wherein the spool loading assembly comprises a support arm rotatable between the taping position and the loading position, wherein the rigid frame is configured to receive the support arm at a first location on a first side of the centerline axis, and at a second location on a second side of the centerline axis opposite the first side.

A further embodiment of any of the foregoing road taping machines, wherein the rigid frame obstructs removal of the tape spool when the spool loading assembly is in the taping position but not when the spool loading assembly is in the loading position.

A further embodiment of any of the foregoing road taping machines, wherein the spool loading assembly comprises a support arm pivotably anchored with respect to the rigid frame at a first end, and connected to the tape spool axle at a second end distal from the first end, such that the spool loading assembly is adjustable between the taping position and the loading position by rotation of the support arm to displace the second end and thereby the tape spool axle.

A further embodiment of any of the foregoing road taping machines, wherein the second end of the tape spool axle is cantilevered and exposed while the spool loading assembly is in the loading position.

A further embodiment of any of the foregoing road taping machines, wherein spool loading assembly further comprises a support mount anchored to the rigid frame, and extending away from the rigid frame to a pivot mount location that pivotably receives the support arm, such that the support arm is stationary with respect to the rigid frame and the pivot arm is rotatable relative to the rigid frame.

A further embodiment of any of the foregoing road taping machines, wherein: the pivot arm rotates toward parallel with the support arm when pivoting into the taping position, thereby positioning the tape spool axle at a position closest to the bottom side of the rigid frame; and the pivot arm rotates towards normal to the support arm when pivoting into the loading position, thereby positioning the tape spool axle at a position furthest from the bottom side of the rigid frame.

A further embodiment of any of the foregoing road taping machines, further comprising a fluid dampener attached to the pivot arm and the support arm, such that the fluid dampener resists rotation of the piston arm towards the taping position.

A further embodiment of any of the foregoing road taping machines, wherein resisting rotation of the pivot arm towards the taping position comprises slowing the rotation of the pivot arm towards the taping position such that the pivot arm is prevented from impacting the rigid frame at damaging speeds.

A further embodiment of any of the foregoing road taping machines, wherein the loading position corresponds to a substantially upright orientation of the pivot arm, such that when the spool loading assembly is in the loading position and the road taping machine is in an upright position with the wheels on flat ground, no component of gravitational force on the tape spool axle biases the spool loading assembly towards the taping position.

A further embodiment of any of the foregoing road taping machines, wherein the loading position corresponds to a substantially upright toggle position from which external force is required to overcome gravity, in order to move the pivot arm out of the loading position, towards the taping position.

A further embodiment of any of the foregoing road taping machines, wherein the loading position corresponds to slightly off-upright orientation of the pivot arm, such that when the spool loading assembly is in the loading position and the road taping machine is in an upright position with the wheels on flat ground, a component of gravitational force on the tape spool axle biases the spool loading assembly towards the loading position.

A further embodiment of any of the foregoing road taping machines, wherein the rigid frame comprises a taping frame having first and second box walls parallel to each other, and to opposite sides of the spool.

A further embodiment of any of the foregoing road taping machines, wherein edges of the box walls opposite the bottom side of the rigid frame have indented regions positioned and sized to cradle the tape spool axle in the taping position, thereby supporting the tape spool axle and the replaceable spool in the loading position.

A further embodiment of any of the foregoing road taping machines, further comprising: a tamping roller disposed to force road marking tape from the replaceable spool into pavement using the weight of the road taping machine; and a cutting assembly disposed between the tamping roller and the replaceable spool in the taping position, and configured to cut the road marking tape, wherein the cutting assembly and the tamping roller are mounted between the box walls.

A further embodiment of any of the foregoing road taping machines, further comprising a plurality of alignment rollers disposed along a path of the road marking tape between the replaceable spool in the taping position, and the tamping roller.

A further embodiment of any of the foregoing road taping machines, further comprising a removable radial spacer insertable between the tape spool axle and the replaceable spool.

A method of operating a road taping machine having a rigid frame, a tape spool axle disposed to carry a replaceable spool, a tape intake, and a pivot arm disposed to support the tape spool axle, the method comprising: rotating the pivot arm into a loading position wherein the tape spool axle is elevated and distanced from the tape intake; inserting the replaceable spool on the tape spool axle while the pivot arm is in the loading position; rotating the pivot arm into a taping position wherein the spool tape spool axle is depressed and brought closer to the tape intake; feeding road marking tape from the replaceable spool into the tape intake.

The method of the preceding paragraph can optionally include, additionally and/or alternatively, any one or more of the following features, configurations, and/or components:

A further embodiment of the foregoing road taping machine, further comprising, after rotating the pivot arm into the loading position and before inserting the replaceable spool: removing a previous spool from the tape spool axle.

A further embodiment of any of the foregoing road taping machines, further comprising disposing a tape spacer sized to the replaceable spool about the tape spool axle, radially between the tape spool axle and the replaceable spool.

A further embodiment of any of the foregoing road taping machines, wherein rotating the pivot arm into a taping position comprises shifting the pivot arm into a position between the loading position and the taping position, from which gravity is able to draw the tape spool axle and replaceable tape spool toward the taping position.

A further embodiment of any of the foregoing road taping machines, further comprising damping the rotation of pivot arm into the taping position.

A further embodiment of any of the foregoing road taping machines, wherein the damping of the rotation of the pivot arm is accomplished via a gas dampener.

A further embodiment of any of the foregoing road taping machines, wherein rotating the pivot arm into the loading position comprises shifting the pivot arm into a position from which gravity tends to retain the tape spool axle in the loading position.

A further embodiment of any of the foregoing road taping machines, wherein the replaceable spool is not removable from the road taping machine while the tape spool axle is in the taping position.

A road taping machine comprising: a drive section comprising: a drive wheel axle with wheels aligned parallel to a drive axis; a taping section disposed adjacent the drive section along the drive axis, the taping section comprising: a taping frame configured to support a tape spool; and a tamping roller mounted on the taping frame and configured to tamp road marking tape from the tape spool into pavement beneath the road taping machine; and a displacement mechanism comprising: an offset plate fixedly anchored to one of the drive section and the taping section, and extending laterally therebetween, the offset plate including a first lateral groove therethrough; and a fastener anchored to the other of the drive section and the taping section, and translatably secured through the first lateral groove, such that the fastener can be tightened to the offset plate to lock the taping section in place relative to the drive section, and loosened from the offset plate to permit the taping section to be translated laterally relative to the drive section.

The road taping machine of the preceding paragraph can optionally include, additionally and/or alternatively, any one or more of the following features, configurations, and/or components:

A further embodiment of the foregoing road taping machine, wherein the offset plate is fixedly anchored to the drive section, and the fasteners are anchored to the taping section.

A further embodiment of any of the foregoing road taping machines, wherein the fastener comprises a plurality of screws passing through the lateral groove, anchored to the other of the drive section and the taping section, and threaded into nuts to clamp the offset plate in a tightened position.

A further embodiment of any of the foregoing road taping machines, wherein the displacement mechanism further comprises a receiver plate parallel to the offset plate and mounted on the other of the drive section and the taping section, such that the fastener is anchored to the other of the taping section and the drive section through the receiver plate.

A further embodiment of any of the foregoing road taping machines, wherein the fastener comprises a bolt secured through the offset plate and through the lateral groove, secured opposite the offset plate from the receiver plate by one of a nut and a lever nut connector, and secured opposite the receiver plate from the offset plate by the other of the nut and the lever nut connector.

A further embodiment of any of the foregoing road taping machines, wherein the taping section further comprises a cutting assembly disposed to cut the road marking tape, and the drive section further comprises a motor configured to drive the cutting assembly.

A further embodiment of any of the foregoing road taping machines, wherein lateral positions of the wheels define outermost lateral locations of the drive section.

A further embodiment of any of the foregoing road taping machines, wherein operation of the displacement mechanism permits translation of the taping section to extend laterally outside of the outermost lateral locations of the drive section.

A further embodiment of any of the foregoing road taping machines, wherein translation of the taping section also laterally translates the tamping roller relative to the drive wheel axle.

A further embodiment of any of the foregoing road taping machines, wherein the displacement mechanism is the only rigid connection between the drive section and the taping section.

A further embodiment of any of the foregoing road taping machines, drive section and the taping section are additionally connected by compliant members.

A further embodiment of any of the foregoing road taping machines, wherein the compliant members comprise at least one of electrical cables and pneumatic hoses.

A further embodiment of any of the foregoing road taping machines, wherein the drive section further comprises a drive mechanism configured to push the road taping machine;

A further embodiment of any of the foregoing road taping machines, wherein the drive mechanism comprises at least one of handlebars and a tow connection.

A road tape applicator apparatus for applying pavement tape to a pavement surface, the apparatus comprising: a rear control portion comprising: a steering control; a power module; a least one rear wheel for engagement with the pavement surface to support the rear control portion; and a rear frame to which the steering control, power module, and at least one rear wheel are attached, the rear frame having a rear centerline axis; a front applicator portion comprising: an applicator assembly configured to apply the pavement tape to the pavement surface, the applicatory assembly comprising a tamping roll; a least one front wheel for engagement with the pavement surface to support the rear applicator portion; and a front frame to which the tamping roll and the at least one rear wheel are attached, the front frame having a front centerline axis; a displacement mechanism configured to allow the front frame to shift laterally with respect to the rear frame to selectively align or offset the front centerline axis with respect to the rear centerline axis, the displacement mechanism comprising a fastener to fix the front frame t to the rear frame to prevent relative lateral shifting.

A method of operating a road taping machine having a drive section and a taping section connected by a displacement mechanism, the drive section including wheels, the taping section including a hose spool mount and a tamping roller disposed to tamp road marking tape from the hose spool mount into pavement, the method comprising: ascertaining a tape striping target location relative to a width of the drive section; unbinding a fastener of the displacement mechanism to permit translation of the taping section relative to the drive section; sliding the taping section relative to the drive section along a plane normal to a drive axis of the road taping machine, until the displacement of the taping section permits taping at the tape striping target location; binding the fastener, thereby locking the taping section relative to the drive section; and driving the road taping machine via the taping section, while applying the road marking tape.

The method of the preceding paragraph can optionally include, additionally and/or alternatively, any one or more of the following features, configurations, and/or components:

A further embodiment of the foregoing method, wherein unbinding the fastener comprises removing or loosening a bolt or screw, and wherein binding the fastener comprises respectively replacing or tightening the bolt or screw.

A further embodiment of any of the foregoing methods, wherein loosening the bolt or screw comprises turning a lever nut connector into an unlocked position, and wherein tightening the bolt or screw comprises turning the lever nut connector into the locked position.

A further embodiment of any of the foregoing methods, wherein the taping section and the drive section comprise first and second parallel plate, respectively, and wherein binding the fastener comprises locking the first plate to the second plate.

A further embodiment of any of the foregoing methods, wherein one of the first and second plates is an offset plate with a lateral groove, and with greater lateral width than the other of the first and second plates, such that sliding the taping section relative to the drive section comprises sliding the fastener, while unbound, within the lateral groove.

A further embodiment of any of the foregoing methods, wherein ascertaining a tape striping target location relative to a width of the drive section comprises determining that tape is required in a location not accessible to the taping section, in its current position relative to the drive section.

A further embodiment of any of the foregoing methods, wherein driving the road taping machine via the taping section comprises one of pushing or pulling the road taping machine along the drive axis.

A road taping machine comprising: a wheeled frame; a spool axis rotatably mounted on the wheeled frame and configured to receive and rotatably support a first spool of road marking tape and a second spool of road marking tape axially adjacent the first spool of road marking tape; at least one tamping roller disposed to tamp tape from both the first spool of road marking tape and the second spool of road marking tape into a surface beneath the wheeled frame; a first set of alignment rollers defining a first tape path from the first spool of road marking tape to the at least one tamping roller; a second set of alignment rollers defining a second tape path from the second spool of road marking tape to the at least one tamping roller; and a road marking tape cutting assembly disposed along the first tape path but not along the second tape path.

The road taping machine of the preceding paragraph can optionally include, additionally and/or alternatively, any one or more of the following features, configurations, and/or components:

A further embodiment of the foregoing road taping machine, wherein at least some rollers are shared between the first set of alignment rollers and the second set of alignment rollers.

A further embodiment of any of the foregoing road taping machines, wherein the first set of alignment rollers includes at least a first subset of the second set of alignment rollers.

A further embodiment of any of the foregoing road taping machines, wherein the first and second sets of alignment rollers share a second subset of alignment rollers disposed along the first and second tape paths between the cutting assembly and the at least one tamping roller.

A further embodiment of any of the foregoing road taping machines, wherein the first set of alignment rollers includes a first subset of alignment rollers displaceable towards the at least one tamping roller to shorten a portion of the first tape path between the cutting assembly and the at least one tamping roller.

A further embodiment of any of the foregoing road taping machines, wherein the at least one tamping roller comprises a first tamping roller configured to receive tape along both the first tape path and the second tape path.

A further embodiment of any of the foregoing road taping machines, wherein the first tape path and the second tape path are usable simultaneously, such that tape from the first spool moves along the first set of alignment rollers to the tamping roller while tape from the second spool moves along the second set of alignment rollers to the tamping roller.

A further embodiment of any of the foregoing road taping machines, wherein tape from the first and second spools are received side-by-side on the tamping roller, thereby permitting parallel dispensing of broken tape lines from the first spool and unbroken tape lines from the second spool, simultaneously.

A method of operating a road taping machine having a spool axis, a tamping roller, and a cutting assembly disposed between the tamping roller and the spool axis, the method comprising: rotatably mounting a first tape spool on the spool axis; rotatably mounting a second tape spool on the spool axis, adjacent the first tape spool; routing tape from the first tape spool along a first tape path at least partially defined by a plurality of alignment rollers, the first tape path extending through the cutting assembly to the tamping roller; routing tape from the second tape spool along a second tape path to the tamping roller, bypassing the cutting assembly; and driving the road taping machine along a taping path so as to simultaneously apply tape from the first and second spools, in parallel.

The method of the preceding paragraph can optionally include, additionally and/or alternatively, any one or more of the following features, configurations, and/or components:

A further embodiment of the foregoing method, further comprising cutting the tape from the first tape spool using the cutting assembly, while simultaneously applying the tape from the first and second spools, in parallel.

A further embodiment of any of the foregoing methods, wherein simultaneously applying tape from the first and second spools, in parallel, comprises applying a continuous section of the tape from the second spool while simultaneously applying a plurality of sequential, interrupted sections of the tape from the first spool, parallel to the tape from the second spool.

A further embodiment of any of the foregoing methods, wherein the second tape path is at least partially defined by a subset of the plurality of alignment rollers.

A further embodiment of any of the foregoing methods, wherein the subset of the plurality of alignment rollers comprises all of the alignment rollers disposed between the cutting assembly and the tamping.

A road taping machine comprising: a wheeled frame; a spool axle supported on the wheeled frame and disposed to receive a spool of road marking tape; a tamping roller rotatably mounted on the wheeled frame, in line with wheels of the wheeled frame; a plurality of alignment rollers defining a tape path from the spool to the tamping roller; and a splicing platform disposed adjacent and along the tape path.

The road taping machine preceding paragraph can optionally include, additionally and/or alternatively, any one or more of the following features, configurations, and/or components:

A further embodiment of the foregoing road taping machine, further comprising a cutting assembly disposed along the tape path, between the spool and the tamping roller, wherein the splicing platform is situated between the cutting assembly and the spool.

A further embodiment of any of the foregoing road taping machines, wherein the splicing platform includes a cutting guide oriented generally orthogonal to the tape path.

A further embodiment of any of the foregoing road taping machines, wherein the cutting guide is a groove or slot.

SUMMATION

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, alignment or shape variations induced by thermal, rotational or vibrational operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A road taping machine configured to carry and apply road marking tape to pavement, the road taping machine comprising:

a spool mount disposed to receive a spool of the road marking tape;

a tamping roller configured to receive the road marking tape from the spool, and force the road marking tape into the pavement;

a blade assembly disposed between the spool mount and the tamping roller, the blade assembly configured to cut the road marking tape;

a plurality of positioning rollers disposed between the blade assembly and the tamping roller and configured to retain one side of the road marking tape between the blade assembly and the tamping roller; and a pivot arm disposed to support a subset of the positioning rollers, thereby permitting at least one of the plurality of positioning rollers to deflect while the blade assembly cuts the road marking tape, such that a tape path along the plurality of positioning rollers to the tamping roller is reduced.

2. The road taping machine of claim 1, wherein permitting at least one of the plurality of positioning rollers to deflect while the blade assembly cuts the road marking tape comprises allowing the pivot arm to rotate towards the tamping roller, the road taping machine further comprising a rotatable arm extending from a pivot towards the tamping roller.

3. The road taping machine of claim 2, further comprising a biasing spring configured to drive the plurality of positioning rollers towards a position further from the tamping roller when not constrained by reduction of slack in the road marking tape between the blade assembly and the tamping roller.

4. The road taping machine of claim 3, further comprising a structural frame supporting the spool mount, the blade assembly, the pivot, and the tamping roller, wherein the biasing spring extends from the structural frame to the pivot arm.

5. The road taping machine of claim 4, wherein pivot arm has a V-shaped profile, with a first leg of the V-shaped profile carrying the plurality of positioning rollers, and a second leg of the V-shaped profile attached to the biasing spring.

6. The road taping machine of claim 1, further comprising a tape intake roller disposed between the blade assembly and the spool mount.

7. The road taping machine of claim 6, further comprising a rotational coupling between the tape intake roller and the tamping roller.

8. The road taping machine of claim 1, wherein the blade assembly comprises a first blade and a second blade configured to clamp together to cut the road marking tape, such that the road marking tape is held by the blade assembly while being cut, and slack in the road marking tape between the blade assembly and the tamping roller is taken in via the deflection of the subset of the positioning rollers.

9. A method of dispensing sections of road marking tape to pavement via a road taping machine, the method comprising:

unspooling the road marking tape from a spool, through a blade assembly, to a tamping roller that forces the road marking tape into the pavement via the weight of the road taping machine;

cutting the road marking tape using the blade assembly;

retaining the road marking tape in engagement with a plurality of positioning rollers in first positions along a path between the blade assembly and the tamping roller; and displacing a subset of the plurality of positioning rollers toward second positions closer to the tamping roller, while cutting the road marking tape, thus shortening the path; and displacing the subset of the plurality of positioning rollers back into the first position once the road marking tape has been cut.

10. The method of claim 9, wherein displacing the subset of the plurality of positioning rollers comprises rotating a pivot arm to which the subset of the plurality of positioning rollers is attached.

11. The method of claim 10, wherein displacing the subset of the plurality of positioning rollers back into the first position comprises biasing the pivot arm towards the first position with a spring, such that the subset of the plurality of positioning rollers rests at the first position when not forced toward the second position by reduction of slack in the road marking tape between the blade assembly and the tamping roller.

12. The method of claim 9, wherein cutting the road marking tape using the blade assembly comprises first clamping then shearing the road marking tape between a first blade and a second blade.

13. The method of claim 12, wherein the displacing of the subset of the plurality of positioning rollers toward the second positions occurs while the road marking tape is clamped between the first and second blades, and before the road marking tape is sheared by the first and second blades.

14. The method of claim 9, further comprising advancing the road taping machine along the pavement continuously through multiple iterations of unspooling, cutting, and applying the tape to pavement.

15. A road taping machine disposed to apply road marking tape from a spool into pavement via a tamping roller, the road taping machine comprising:

a blade assembly disposed between the spool and the tamping roller to cut the road marking tape; and a tape alignment roller disposed between the blade assembly and the tamping roller to retain the road marking tape therebetween;

wherein the tape alignment roller is movable to shorten a tape path between the blade assembly and the tamping roller.

16. The road taping machine of claim 15, further comprising:

a structural frame supporting the spool, the tamping roller, and the blade assembly; and a first pivot arm supporting the tape alignment roller, the first pivot arm rotatably anchored to the structural arm and pivotable between a first position and a second position, the first position defining a longer tape path between the blade assembly and the tamping roller than the second position.

17. The road taping machine of claim 16, further comprising a first biasing element disposed to bias the first pivot arm towards the first position, away from the second position.

18. The road taping machine of claim 17, wherein the first biasing element is a spring connected between the first pivot arm and the structural frame.

19. The road taping machine of claim 16, further comprising a plurality of stationary rollers disposed between the spool and the tape alignment rollers, the stationary rollers being affixed to the structural frame.

* * * * *